US010913298B2

(12) United States Patent
Yang et al.

(10) Patent No.: US 10,913,298 B2
(45) Date of Patent: Feb. 9, 2021

(54) MULTIPLE SIZE MEDIA HOLDER ASSEMBLY FOR A MOBILE PRINTER

(71) Applicant: Datamax-O'Neil Corporation, Fort Mill, SC (US)

(72) Inventors: Liuzhi Yang, Suzhou (CN); Guy Heaton, Mission Viejo, CA (US); Ching Hong Chua, Singapore (SG)

(73) Assignee: DATAMAX-O'NEIL CORPORATION, Altamonte Springs, FL (US)

( * ) Notice: Subject to any disclaimer, the term of this patent is extended or adjusted under 35 U.S.C. 154(b) by 0 days.

(21) Appl. No.: 16/611,550

(22) PCT Filed: May 8, 2017

(86) PCT No.: PCT/CN2017/083394
§ 371 (c)(1),
(2) Date: Nov. 7, 2019

(87) PCT Pub. No.: WO2018/205074
PCT Pub. Date: Nov. 15, 2018

(65) Prior Publication Data

US 2020/0223239 A1 Jul. 16, 2020

(51) Int. Cl.
*B41J 15/04* (2006.01)
*B41J 11/00* (2006.01)
*B41J 13/10* (2006.01)

(52) U.S. Cl.
CPC ..... *B41J 15/042* (2013.01); *B41J 11/0025* (2013.01); *B41J 13/10* (2013.01)

(58) Field of Classification Search
CPC ... B41J 15/042; B41J 3/39; B41J 15/04; B41J 15/16; B41J 13/10; B41J 11/0025
See application file for complete search history.

(56) References Cited

U.S. PATENT DOCUMENTS 6,130,699 A * 10/2000 Christensen ..... B41J 15/02 347/218
9,327,931 B2 5/2016 Izumi
(Continued)

FOREIGN PATENT DOCUMENTS

CN 1286175 A 3/2001
CN 1106948 C 4/2003
(Continued)

OTHER PUBLICATIONS

International Search Report of the International Searching Authority for PCT/CN2017/083394 dated Jan. 29, 2018.
(Continued)

*Primary Examiner* — Thinh H Nguyen
(74) *Attorney, Agent, or Firm* — Alston & Bird LLP

(57) ABSTRACT

A media holder assembly (11) includes a base (13) secured to a platform (15). The platform (15) has a central cylindrical depression (16). A first hub (20) protrudes from the center of the depression (16). A first spring (24), concentric to the first hub (20) biases a second, ring-shaped hub (30) which is fitted over the first spring (24). The second hub (30) is slidably engaged to the first hub (20). A second spring (26), concentric to the first hub (20) and sized to fit around the second hub (30), biases a third, ring-shaped hub (40) which is fitted over the second spring (26). The third hub (40) is slidably engaged to the second hub (30) and to the inner wall (17) of the cylindrical depression (16). The first hub (20), the second hub (30), and the third hub (40) are sized to accommodate media rolls of different sizes.

22 Claims, 9 Drawing Sheets

(56) References Cited

U.S. PATENT DOCUMENTS

| | | | |
|---|---|---|---|
| 2012/0032021 | A1 | 2/2012 | Morinaga et al. |
| 2015/0246568 | A1 | 9/2015 | Nagashima et al. |
| 2017/0144853 | A1 | 5/2017 | Gonzalez et al. |

FOREIGN PATENT DOCUMENTS

| | | | |
|---|---|---|---|
| CN | 2003-276911 | A | 10/2003 |
| CN | 10153110 | A | 9/2009 |
| CN | 102556727 | A | 7/2012 |
| CN | 202826758 | U | 3/2013 |
| CN | 103640343 | A | 3/2014 |
| CN | 105377733 | A | 3/2016 |
| CN | 106414093 | A | 2/2017 |
| EP | 0805042 | A2 | 11/1997 |
| EP | 2380837 | A2 | 10/2011 |
| JP | 2000-072288 | A | 3/2000 |
| JP | 3758118 | B2 | 3/2006 |
| JP | 2007090707 | A | 4/2007 |
| JP | 5114807 | B1 | 1/2013 |
| JP | 2013-047139 | A | 3/2013 |
| JP | 2014-114091 | A | 6/2014 |
| JP | 2016088737 | A | 5/2016 |
| WO | 2007/037173 | A1 | 4/2007 |

OTHER PUBLICATIONS

Extended European Search Report issued in European Application No. 17908874.5, dated Nov. 6, 2020, 10 pages.
Office Action issued in Chinese Application No. 201780090556.6 dated Nov. 18, 2020, 8 pages.

* cited by examiner

MULTIPLE SIZE MEDIA HOLDER ASSEMBLY FOR A MOBILE PRINTER

FIELD OF THE INVENTION

The present invention relates to printers, and especially to mobile printers. In particular, the present invention is concerned with mobile printers which employ cylindrical media rolls.

BACKGROUND

Generally speaking mobile printers are designed for a specific media core size. This specific design restriction limits users' choices in exploring other media types.

Some mobile printers have designs to accommodate more than one media core size. Generally these designs require some disassembly or part replacement to adapt to each new core size. This exchange takes time and can delay printing.

In other instances, printers have switching mechanisms which alternate media core hubs to accommodate more than one media core size. However, these mechanisms may take up additional and valuable real estate in the printer. Additionally, the mechanisms do require operator to actively select the correct media hub as opposed to simply using another media core size without changes the printer.

Therefore, a need exists for a printer and media ring assembly which can accommodate a variety of media core sizes without part changes and without active switching of hubs by the printer operator. The design should be simple and be adaptable for different printers and different media core sizes.

SUMMARY

Accordingly, in one aspect, the present invention embraces a printer having a pair of media holder sub-assemblies.

In an exemplary embodiment, each sub-assembly may include a platform having a generally cylindrical depression central to the platform. The cylindrical depression has an inner wall. A first hub sized to support a first media roll protrudes from the center of the cylindrical depression. The first hub has a height greater than the depth of the cylindrical depression, that is, the first hub is at a level higher than the platform. Each sub-assembly further may include a first spring concentric to the first hub and disposed in the cylindrical depression. Further may be included a second hub sized to support a second media roll. The second hub is concentric to the first hub. The second hub is supported by the first spring in the cylindrical depression. The first spring biases the second hub to a height or level substantially equal to the height or level of the first hub. Further, the second hub is slidably engaged to the first hub. Each sub-assembly further may include a second spring, concentric to the first hub and sized to fit around the second hub. A third hub sized to support a third media roll and sized to fit around the second hub and within the inner wall of the cylindrical depression is supported by the second spring. The second spring biases the third hub to a height substantially equal to the height of the first hub. The third hub is slidably engaged to the second hub and to the inner wall of the cylindrical depression.

In another exemplary embodiment, the slidable engagement of the second hub to the first hub allows movement of the second hub from a height substantially equal to the height of the first hub to a position lower in height than the height of the first hub. Further, the slidable engagement between the third hub and the second hub, and the slidable engagement between the third hub and the inner wall of the cylindrical depression allows movement of the third hub from a height substantially equal to the height of the first hub to a position lower in height than the height of the first hub.

In another exemplary embodiment, the cylindrical depression has a bottom and at least one stop on the inner wall. The stop is a first predetermined distance from the bottom of the inner wall. The first hub has an exterior surface and a bottom. The first hub has at least one stop on the exterior surface of the first hub. The stop is a second predetermined distance from the bottom of the first hub. The second hub has a bottom, an inner surface, and an exterior surface. The second hub has at least one retainer at the bottom of the inner surface. The retainer is disposed in a position below the at least one stop on the first hub. The second hub has at least one stop on the exterior surface. The third hub has an inner surface and an exterior surface. The third hub may include at least one retainer on the exterior surface and disposed in a position below the at least one stop in on the inner wall of the cylindrical depression. The third hub has at least one retainer on the inner surface of the third hub. The stop is aligned below the at least one stop on the exterior surface of the second hub.

In another exemplary embodiment, the first predetermined distance is substantially equal to the difference between the height of the first hub and the depth of the cylindrical depression.

In another exemplary embodiment, the second predetermined distance is substantially equal to the difference between the height of the first hub and the depth of the cylindrical depression.

In another exemplary embodiment, the media holder sub-assemblies are configured to slidably adjust based upon a media roll being loaded on the media holder. The distance between the platforms on the opposedly mounted media holder sub-assemblies is substantially equal to the length of the media roll.

In another exemplary embodiment, when a media roll sized to be supported by the second hub is mounted in the media holder, pressure is applied to the third hub on each of the media holder sub-assemblies, thus compressing the second spring and sliding the third hub towards the bottom of the cylindrical depression.

In another exemplary embodiment, when a media roll sized for the first hub is being mounted in the media holder, pressure is applied to second hub on each of the media holder sub-assemblies, thus compressing the first spring and sliding the second hub towards the bottom of the cylindrical depression.

In another exemplary embodiment, the second spring is compressed and the third hub slides towards the bottom of the cylindrical depression when pressure is applied to the second hub because of the slidable engagement of the second hub to the third hub.

In yet another exemplary embodiment of the invention, the first hub is sized to support a media roll having a substantially 0.4 inch inner diameter. The second hub is sized to support a media roll having a substantially 0.75 in inner diameter. The third hub is sized to support a media roll having a substantially 1.0 inch inner diameter. However, media rolls having alternate inner diameters are also contemplated.

In another exemplary embodiment of the invention, the first spring has an uncompressed height greater than the height of the second hub; and the second spring has an uncompressed height greater than the height of the third hub.

In another aspect, the present invention embraces a media holder. The media holder includes a platform having a flange and a generally cylindrical depression central to the platform. The cylindrical depression also has an inner wall. A first hub having an exterior surface to support a first media roll protrudes from the center of the cylindrical depression. The first hub has a height greater than the depth of the cylindrical depression. The media holder also may also include a first spring concentric to the first hub and disposed in the cylindrical depression. The media holder may also include a second hub having an exterior surface to support a second media roll. The second hub is concentric to the first hub. The second hub is supported by the first spring in the cylindrical depression. The first spring biases the second hub to a height substantially equal to the height of the first hub. The second hub is slidably engaged to the first hub.

In another exemplary embodiment, the media holder further may have a second spring concentric to and sized to fit around the second hub. The media holder may further include a third hub having an exterior surface to support a third media roll. The third hub is concentric to the second hub. The third hub is supported by the second spring. The second spring biases the third hub to a height substantially equal to the height of the first hub. The third hub is slidably engaged to the second hub.

In another exemplary embodiment, the slidable engagement of the third hub to the second hub allows movement of the third hub from a position of substantially equal height to the height of the first hub to a position lower in height than the height of the first hub. The slidable engagement between the second hub and the first hub allows movement of the second hub from a height substantially equal to the height of the first hub to a position lower in height than the height of the first hub.

In yet another exemplary embodiment, when a media roll sized to be supported by the exterior surface of the second hub is supported by the second hub, pressure is applied to the third hub of the media holder, thus compressing the second spring and sliding the third hub towards the bottom of the cylindrical depression.

In yet another exemplary embodiment, when a media roll sized to be supported by the exterior surface of the first hub is supported by the first hub, pressure is applied to the second hub of the media holder, thereby compressing the first spring and sliding the second hub towards the bottom of the cylindrical depression. Also, the second spring is compressed and the third hub slides towards the bottom of the cylindrical depression when pressure is applied to the second hub, based upon the slidable engagement of the second hub to the third hub.

In another exemplary embodiment, the second hub has an inner surface. The second hub has at least one stop on the exterior surface. The third hub has an inner surface. The third hub has at least one retainer on the inner surface of the third hub. The at least one retainer on the inner surface of the third hub is positioned to align below the at least one stop on the exterior surface of the second hub.

In another exemplary embodiment, the exterior surface of the first hub is sized to support a media roll having a substantially 0.4 inch inner diameter. The surface of the second hub is sized to support a media roll having a substantially 0.75 in inner diameter. The surface of the third hub is sized to support a media roll having a substantially 1.0 inch inner diameter. However, it is to be understood that other sizes can be accommodated.

In yet another exemplary embodiment of the media holder, the first spring has a spring constant different from the spring constant of the second spring.

In another exemplary embodiment of the media holder the first spring has a spring constant less than or equal to the spring constant of the second spring.

Accordingly, in another aspect, the present invention embraces a media holder assembly for a printer having a pair of opposedly mounted media holder sub-assemblies.

In an exemplary embodiment of the media holder assembly, each sub-assembly is has a base and a platform secured to the base. The platform has a generally cylindrical depression central to the platform. The cylindrical depression has an inner wall. Each sub-assembly has a first hub sized for a first media roll. The first hub protrudes from the center of the cylindrical depression and has a height greater than the depth of the cylindrical depression. A first spring concentric to the first hub and disposed in the cylindrical depression is further provided. Further provided is a second hub sized for a second media roll. The second hub is ring-shaped. The second hub ring is concentric to the first hub and has a height less than the height of the first hub. The second hub is profiled to fit over the first spring in the cylindrical depression. The first spring biases the second hub to a level substantially equal to the height of the first hub. The second hub is slidably engaged to the inner wall of the cylindrical depression. A second spring is provided. The second spring is concentric to the first hub and sized to fit inside the second hub. Further, a third hub sized for a third media roll is provided. The third hub is ring-shaped. The third hub ring is sized to fit around the first hub and inside the ring of the second hub. The third hub has a height less than the height of the first hub. The third hub is profiled to fit over the second spring. The second spring biases the third hub to a level substantially equal to the height of the first hub. The third hub is slidably engaged to the first hub. The second hub is slidably engaged to the third hub. The pair of media sub-assemblies is opposedly mounted at a distance from each other which is suitable to accommodate a media roll.

In another exemplary embodiment of the of the media holder assembly, the slidable engagement of the third hub to the first hub allows movement of the third hub from a position of equal height to the height of the first hub to a position lower in height than the height of the first hub. Further, the slidable engagement between the second hub and the third hub and between the second hub and the inner wall of the cylindrical depression allows movement of the second hub from a position of equal height to the height of the first hub to a position lower in height than the height of the first hub.

In another exemplary embodiment of the media holder assembly, the cylindrical depression has a bottom and an inner wall. The cylindrical depression has an annular groove at the bottom of the inner wall. The first hub has a bottom and an annular groove around the bottom of the first hub. The second hub has a bottom, an inner diameter, and an outer diameter. The second hub has at least one flange at the bottom of the outer diameter sized to fit in the angular groove on the inner wall of the cylindrical depression. The second hub has a step on the inner diameter. The third hub has an inner diameter and an outer diameter. The third hub has at least one flange on the inner diameter of the third hub. The at least one flange is sized to fit in the annular groove at the bottom of the first hub. The third hub has a step on the outer diameter of the third hub. The step on the third hub is positioned to be aligned on top of the step on the inside diameter of the second hub.

In another exemplary embodiment of the media holder assembly, the annular groove at the bottom of the inner wall of the cylindrical depression has a height substantially equal to the difference between the height of the first hub and the depth of the cylindrical depression. The annular groove at the bottom of the first hub has a height substantially equal to the difference between the height of the first hub and the depth of the cylindrical depression.

In another exemplary embodiment of the media holder, the media holder sub-assemblies are configured to slidably adjust based upon a media roll being loaded on the media holder. The distance between the platforms on the opposedly mounted media holder sub-assemblies are substantially equal to the length of the media roll.

In another exemplary embodiment of the media holder, when a media roll sized for the third hub is being mounted in the media holder, pressure applied to the second hub on each of the media holder sub-assemblies compresses the first spring sliding the second hub towards the bottom of the cylindrical depression.

In yet another exemplary embodiment of the media holder, when a media roll sized for the first hub is being mounted in the media holder, pressure applied to the third hub on each of the media holder sub-assemblies, compresses the second spring, sliding the third hub towards the bottom of the cylindrical depression.

In yet another exemplary embodiment of the media holder, the first spring is compressed and the second hub slides towards the bottom of the cylindrical depression when pressure is applied to the third hub, based upon the slidable engagement of the second hub to the third hub.

In yet another exemplary embodiment of the media holder, the first hub is sized to accommodate a media roll having a 0.4 inch inner diameter. The third hub is sized to accommodate a media roll having a 0.75 in inner diameter. The second hub is sized to accommodate a media roll having a 1.0 inch inner diameter. However, it is to be understood that other media roll sizes can be accommodated.

In yet another exemplary embodiment of the media holder, the first spring has an uncompressed height greater than the height of the second hub. The second spring has an uncompressed height greater than the height of the third hub.

In another aspect, the present invention embraces a printer having a media holder comprised of two opposedly mounted media holder sub-assemblies.

In an exemplary embodiment, each media holder sub-assembly includes a base and a platform secured to the base. The platform has a generally cylindrical depression central to the platform. The cylindrical depression has an inner wall. Each media holder assembly is provided with a first hub sized for a first media roll. The first hub protrudes from the center of the cylindrical depression. The first hub has a height greater than the depth of the cylindrical depression. A first spring concentric to the first hub and disposed in the cylindrical depression is provided. Further included is a second hub sized for a second media roll. The second hub is ring-shaped. The second hub ring is sized to be concentric to the first hub and has a height less than the height of the first hub. The second hub is profiled to fit over the first spring in the cylindrical depression. The first spring biases the second hub to a level substantially equal to the height of the first hub. The second hub is slidably engaged to the inner wall of the cylindrical depression.

In another exemplary embodiment, each media holder sub-assembly of the printer further includes a second spring concentric to the first hub and sized to fit inside the second hub. Also provided is a third hub sized for a third media roll. The third hub is ring-shaped. The third hub ring is sized to fit around the first hub and inside the ring of the second hub. The third hub has a height less than the height of the first hub. The third hub is profiled to fit over the second spring. The second spring biases the third hub to a level equal to the height of the first hub. The third hub is slidably engaged to the first hub. The second hub is slidably engaged to the third hub.

In another exemplary embodiment of the printer, the slidable engagement of the third hub to the first hub allows movement of the third hub from a position of equal height to the height of the first hub to a position lower in height than the height of the first hub. The slidable engagement between the second hub and the third hub and between the second hub and the inner wall of the cylindrical depression allows movement of the second hub from a position of equal height to the height of the first hub to a position lower in height than the height of the first hub.

In yet another exemplary embodiment of the printer, when a media roll sized for the third hub is being mounted in the media holder, pressure is applied to the second hub on each of the media holder sub-assemblies, compressing the first spring and sliding the second hub towards the bottom of the cylindrical depression. Further, when a media roll sized for the first hub is being mounted in the media holder, pressure is applied to third hub on each of the media holder sub-assemblies, compressing the second spring and sliding the third hub towards the bottom of the cylindrical depression. Further, the first spring is compressed and the second hub slides towards the bottom of the cylindrical depression when pressure is applied to the third hub, based upon the slidable engagement of the second hub to the third hub.

In yet another exemplary embodiment of the printer, the media holder sub-assemblies are configured to slidably adjust based upon a media roll being loaded on the media holder. The distance between the platforms on the opposedly mounted media holder sub-assemblies are substantially equal to the length of the media roll to be loaded.

In yet another exemplary embodiment of the printer, the cylindrical depression has a bottom and an inner wall. The cylindrical depression having an annular groove at the bottom of the inner wall. The first hub has a bottom and an annular groove around the bottom of the first hub. The second hub has a bottom, an inner diameter, and an outer diameter. The second hub has at least one flange at the bottom of the outer diameter sized to fit in the angular groove on the inner wall of the cylindrical depression. The second hub has a step on the inner diameter. The third hub has an inner diameter and an outer diameter. The third hub has at least one flange on the inner diameter of the third hub. The at least one flange is sized to fit in the annular groove at the bottom of the first hub. The third hub has a step on the outer diameter of the third hub. The step is positioned to align on top of the step on the inside diameter of the second hub.

In yet another exemplary embodiment of the printer, the annular groove at the bottom of the inner wall of the cylindrical depression has a height substantially equal to the difference between the height of the first hub and the depth of the cylindrical depression. The annular groove at the bottom of the first hub has a height substantially equal to the difference between the height of the first hub and the depth of the cylindrical depression.

In yet another exemplary embodiment of the printer, the first hub is sized to accommodate a media roll having a 0.4 inch inner diameter. The third hub is sized to accommodate a media roll having a 0.75 in inner diameter. The second hub is sized to accommodate a media roll having a 1.0 inch inner diameter.

In yet another exemplary embodiment of the printer, the first spring has an uncompressed height greater than the height of the second hub.

In yet another exemplary embodiment of the printer, the second spring has an uncompressed height greater than the height of the third hub.

In another aspect, the invention embraces a media holder which includes a platform having a flange and a shaped depression central to the platform. The shaped depression has an inner wall. The media holder further includes a first hub having an exterior surface to support a first media roll. The first hub protrudes from the center of the shaped depression and has a height greater than the depth of the shaped depression. A first spring concentric to the first hub and disposed in the shaped depression is provided. Further a second hub having an exterior surface to support a second media roll is provided. The second hub is concentric to the first hub. The second hub is supported by the first spring in the shaped depression. The first spring biases the second hub to a height substantially equal to the height of the first hub. The second hub is slidably engaged to the first hub.

In another exemplary embodiment, the media holder further includes a second spring, concentric to and sized to fit around the second hub. A third hub having an exterior surface to support a third media roll is provided. The third hub is concentric to the second hub. The third hub is supported by the second spring, the second spring biasing the third hub to a height substantially equal to the height of the first hub. The third hub is slidably engaged to the second hub.

In another exemplary embodiment, the first hub, the second hub, and the third hub have a common cross-sectional shape in common with the shaped depression.

In yet another exemplary embodiment, the first hub, the second hub, and the third hub each have cross-sectional shapes unlike the shaped depression.

The foregoing illustrative summary, as well as other exemplary objectives and/or advantages of the invention, and the manner in which the same are accomplished, are further explained within the following detailed description and its accompanying drawings.

DETAILED DESCRIPTION

The present invention embraces a multiple size media holder assembly for a printer and a printer employing such a media holder assembly.

Figure 1:
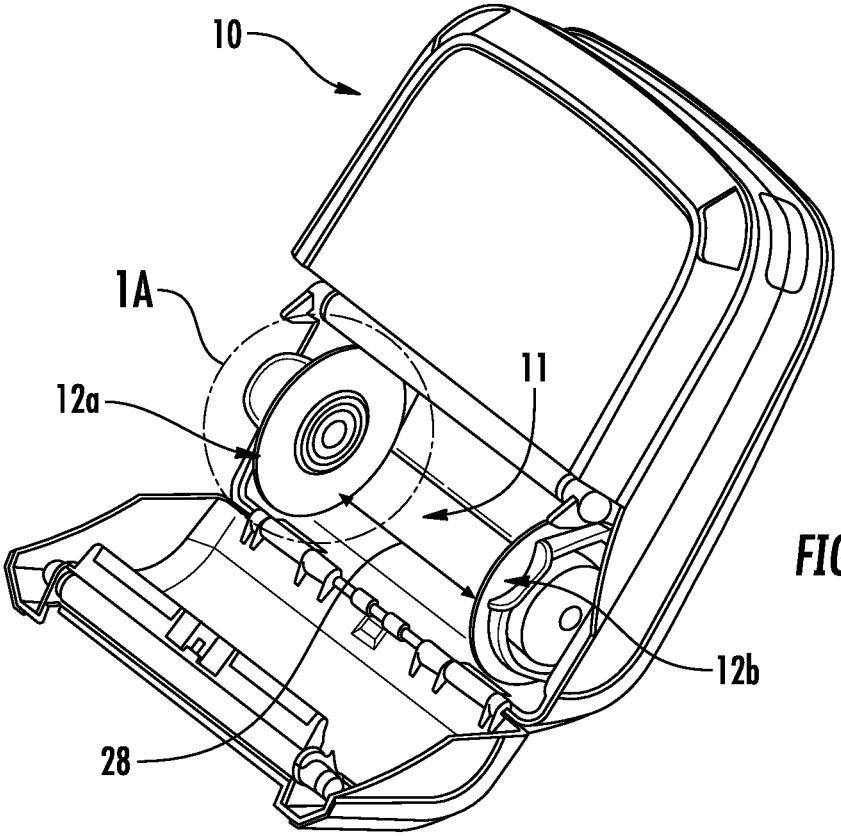
FIG. 1 schematically depicts a printer with a media assembly comprised of two opposedly mounted media sub-assemblies in accordance with the present invention.

In an exemplary embodiment, as seen in FIG. 1, the present invention includes a printer (10), a media holder assembly (11), comprised of a pair of opposedly mounted media holder subassemblies (12*a* & 12*b*). The distance (28) between the media holder subassemblies (12*a* & 12*b*) is sized to accommodate a media roll (not shown).

Figure 1A:
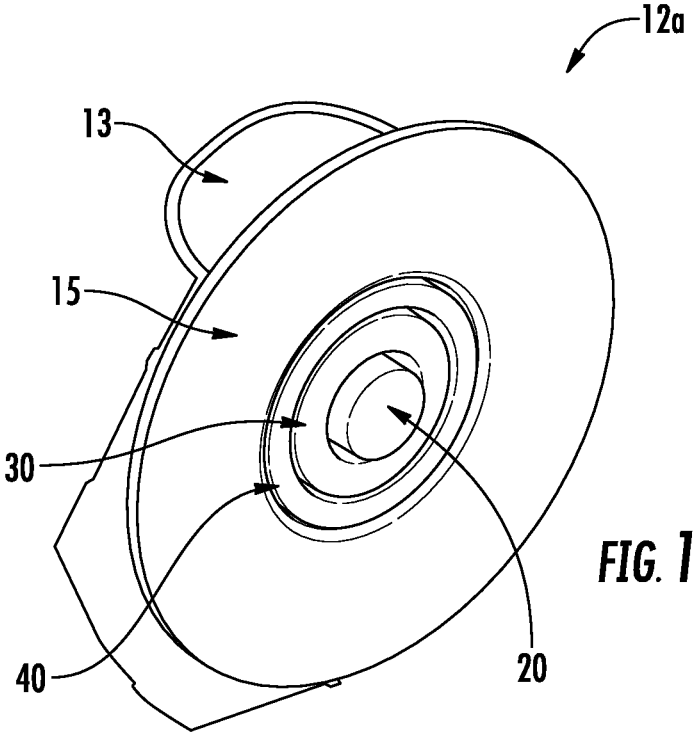
FIG. 1A schematically depicts an enlarged view of one of the media sub-assemblies of FIG. 1.

FIG. 1A shows a magnified view of media sub-assembly (12*a*). Basic components of the media sub-assembly (12*a*) include a base (13), a platform (15) secured to the base, and 3 hubs: first hub (20), second hub (30) and third hub (40), each sized to accommodate the inner diameters of three varying sized media rolls (not shown) and each having an exterior surface (not visible in this view) to support three media rolls of varying inner diameters. The base (13) and the platform (15) can be combined in a single part (not shown) or in the alternative, the base and the platform may be composed of multiple parts.

Figure 2:
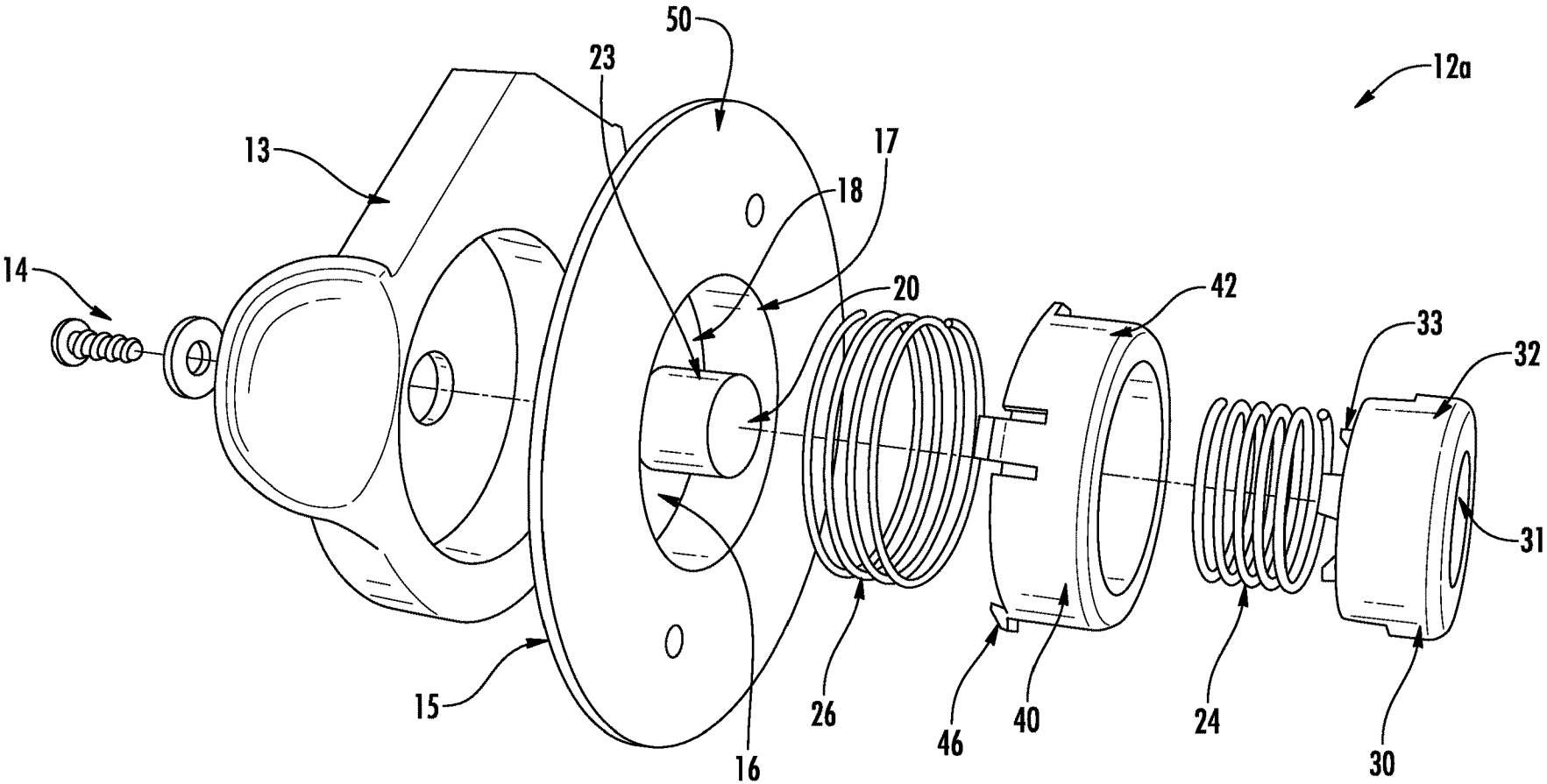
FIG. 2 schematically depicts an exploded view of the media sub-assembly of FIG. 1A.

FIG. 2 shows an exploded view of the media sub-assembly (12*a*) of FIG. 1. The media sub-assembly (12*a*) includes a base (13) and platform (15). The platform (15) is secured to the (base). In the Figure the platform (15) and base (13) are shown secured with a fastener (14) which can be a screw and washer as shown, or other fasteners known in the art. In the alternative, the platform (15) and the base (13) can be molded to form a single part. The platform (15) has a flange (50) and has a central cylindrical depression (16). The cylindrical depression (16) has an inner wall (17), a bottom (18), and at least one stop on the inner wall of the cylindrical depression (not visible in this view). The stop, which will be discussed in more detail in conjunction with FIGS. 4, 5, 6, 7 and 8 could be an annular groove, one or more protruding flanges, one or more of recesses, cutouts, or notches on or in the inner wall (17), or the like. Protruding from the center of the cylindrical depression (16) is the first hub (20). The first hub (20) is sized for a first media roll (not shown). The first hub has an exterior surface (23) to support the first media roll. In the Figure, the first hub is depicted as having a circular cross-section, but other cross-sectional shapes, for example triangular, are contemplated based upon the first hub's (20) exterior surface (23) supporting the first media roll. The first hub (20) may have any cross-sectional shape which can be encompassed by the inner diameter, usually circular, of the media roll and adequately supports it. It can be seen from the Figure that the height of the first hub (20) extends higher than the flange (50). Other features of the first hub (20) will be described in conjunction with subsequent Figures which show those features. A first spring (24) concentric to the first hub (20) is disposed in the cylindrical depression (16). The second hub (30) is sized for a second media roll (not shown) and has an exterior surface (32) for supporting the second media roll. The second hub (30) may be ring-shaped as shown in FIG. 2, or any shape which will support the second media roll. For example, the second hub (30) may have any cross-sectional geometric shape which fits within the inner diameter, usually circular, of the media roll and around the first hub (20). For example the second hub may be triangular in cross-section, having an exterior surface (32) which will support the second media roll. The second hub (30) is concentric to the first hub (20) and has a height less than the height of the first hub (20). The second hub (30) is supported by the first spring (24). For example, the second hub (30) may be profiled to fit over the first spring (24) in the cylindrical depression (16). However, the second hub (30) may be supported by the first spring (24) by a number of other mechanisms or constructions. For example, the second hub (30) may be notched to be supported by the first spring (24). As will be seen in Figures presented hereinafter, the first spring (24) biases the second hub (20) to a height substantially level with that of the first hub (20). A second spring (26) concentric to the first hub (20) and sized to fit around the second hub (30) is also provided. A third hub (40) is provided which is sized for a third media roll (not shown). The third hub (40) is sized to fit around the second hub (30). The third hub (40) has an exterior surface (42) for supporting the third media roll. The third hub (40) may be ring-shaped as shown in the Figure, or any shape which will support the third media roll. For example, the third hub (40) may have any cross-sectional geometric shape which fits within the inner diameter, usually circular, of the third media roll and around the second hub (30). For example the third hub may be triangular in cross-section, having an exterior surface (42) will support the third media roll. Further, the third hub (40) is supported by the second spring (26). For example, and as shown in FIG. 2, the third hub (40) is profiled to fit over the second spring (26). However, other constructions and mechanisms are possible for the third hub (40) to be supported by the second spring as discussed hereinbefore with respect to the second hub (20) and the first spring (24). The second spring (26) biases the third hub to a level substantially equal to that of the first hub (20). It can be seen from the present FIG. 2 that if a media assembly was desired to accommodate only two media rolls, then the third hub and second spring would be unnecessary. However, the present invention also contemplates that more than three media roll sizes could be accommodated by adjusting the sizes of components, including the platform (15), and adding springs and hubs.

When the media sub-assembly (12*a*) is assembled, the second hub (30) is slidably engaged to the first hub (20). To that purpose, one way to accomplish the slidable engagement, without wishing to be limited, is to provide the second hub (30) with at least one retainer (33) which is pictured as a flange, tab, or protrusion on the inner diameter (31) of the second hub (30). The first hub (20) is correspondingly provided with a stop (not visible in this FIG. 2) on the exterior surface (23) of the first hub (20) under or in which the retainer (33) on the second hub (30) is disposed. The stop on the exterior surface (23) of the first hub (20) may be a continuous annular groove for receiving the at least one retainer (33) of the second hub (30). In an alternate embodiment, the stop could be one or more flanges protruding from the exterior surface (21) of the first hub (20). In another embodiment, the at least one stop on the exterior surface (23) of the first hub could be one or more recesses, cutouts, or notches in the exterior surface (23) of the first hub designed to receive the at least one retainer (33) of the second hub (30). The slidable engagement will be discussed in more detail hereinafter.

The third hub (40) and the second hub (30) are in slidable engagement when the media sub-assembly (12*a*) is fully assembled. The slidable engagement will be discussed in more detail hereinafter in conjunction with FIGS. (4, 5, 6, 7, and 8).

The outermost hub, in FIG. 2 this being the third hub (40), is slidably engaged to the inner wall (17) of the cylindrical depression (16). One way to accomplish the slidable engagement is shown in the Figure. Without wishing to be limited, the third hub (40) may be provided with at least one retainer (46) which is pictured as a flange, tab, or protrusion on the exterior surface (42) of the third hub (40). The inner wall (17) of the cylindrical depression (16) is correspondingly provided with a stop (not visible in this Figure) under or in which the retainer (46) on the third hub (40) is disposed. The stop on the inner wall (17) of the cylindrical depression (16) may be a continuous annular groove for receiving the at least one retainer (46) of the third hub (40). In another embodiment, the stop could be one or more flanges protruding from the inner wall (17). In another embodiment, the at least one stop on the inner wall (17) could be one or more recesses, cutouts, or notches in the inner wall (17) designed to receive the at least one retainer (46) of the third hub (40). The slidable engagement will be discussed in more detail hereinafter.

Figure 3:
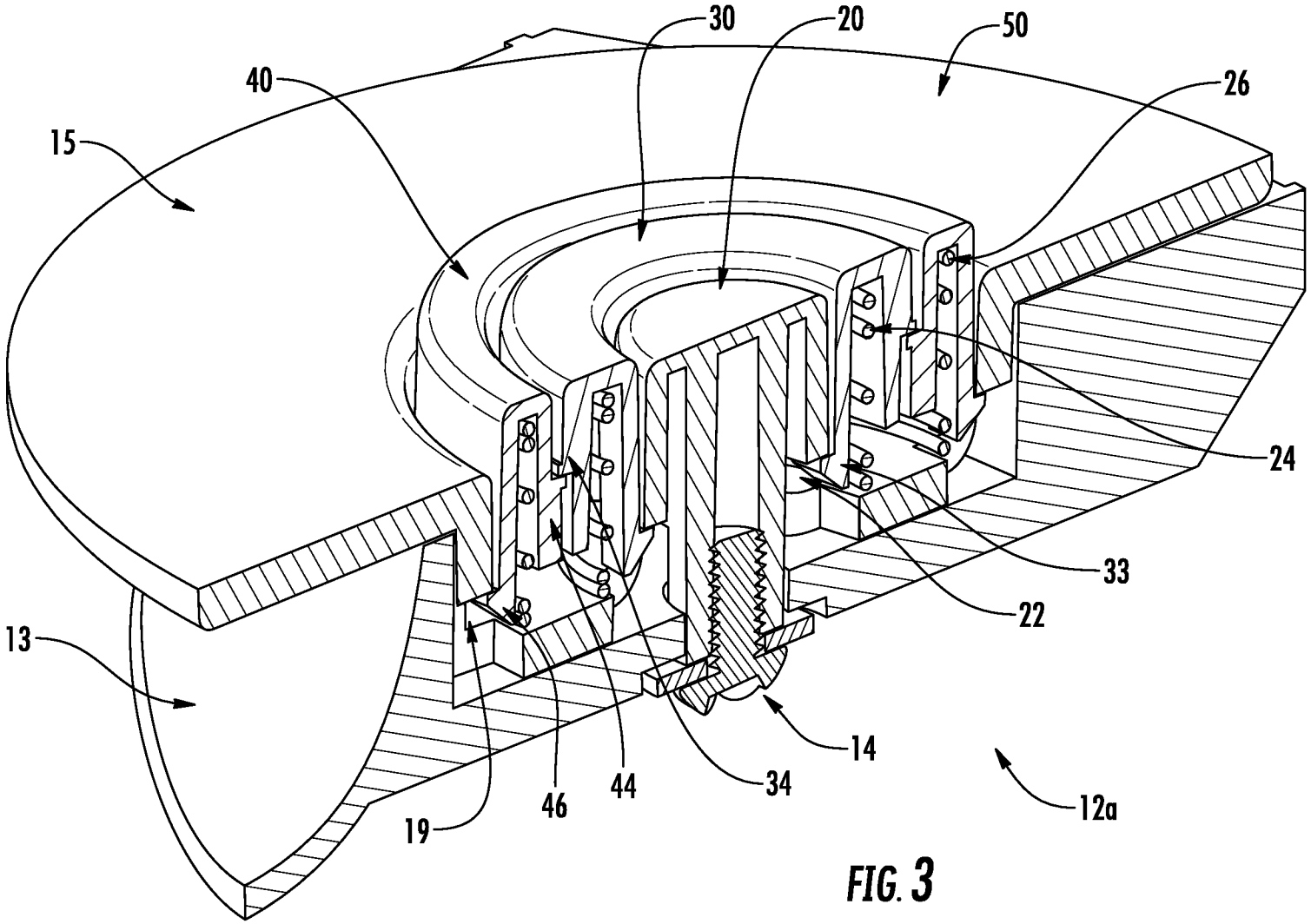
FIG. 3 is a cross-sectional view of the media sub-assembly of FIG. 1A.

Referring now to FIG. 3, which is a cross-sectional view of the media holder sub-assembly (12*a*) of FIG. 2, now fully assembled without a media roll in place.

From the present FIG. 3, it can be seen as described hereinbefore, that the first spring (24) and the second spring (26) bias the second hub (30) and the third hub (40) respectively to a height level with the height of the first hub (20) and above that of the flange (50).

Exemplary embodiments of mechanisms to accomplish the slidable engagements between components are visible in the current view. In the FIG. 3, the first hub (20) has a stop (22) on the exterior surface (23). In FIG. 3, the stop (22) is a recess or cutout disposed near the bottom (21) of the first hub (20). However, as discussed hereinbefore, the stop (22) could be one or more tabs or flanges protruding from the exterior surface (23) or notches in the exterior surface (23). The stop (22) may be a continuous annular groove or a series of recesses, cutouts, or notches. The second hub (30) may be provided with at least on retainer (33) on the inner diameter (31). In the present FIG. 3, the at least one retainer (33) is illustrated as a tab or flange on the inner diameter (31) as discussed hereinbefore. The at least one retainer (33) is disposed in the stop (22) of the first hub (20). As can be seen, the stop (22) limits the biasing of the second hub (30) by the first spring (24). As discussed hereinbefore, but not visible in the previous Figures, the cylindrical depression (16) is provided with at least one stop (19). In the present FIG. 3, the at least one stop (19) is a recess or cutout in the inner wall (17). The recess may be a continuous annular groove or may be a series of recesses, cutouts, or notches. In another embodiment, the at least one stop may be one or more tabs protruding from the inner wall (17) of the cylindrical depression (16). The third hub (40) is provided with at least one retainer (46), depicted as a tab positioned at the bottom of the exterior surface (42) of the third hub (40) in the present FIG. 3. The at least one retainer (46) of the third hub (40) engages the stop (19), in this case a recess, on the inner wall (17) of the cylindrical depression (16). The stop (19) limits the biasing of the third hub (40) by the second spring (26).

The second hub (30) and the third hub (40) are slidably engaged to each other. Without wishing to be limited, one way to accomplish this slidable engagement is to provide the exterior surface (32) of the second hub (30) with a stop (34) shown in the present FIG. 3 as a step profile. The third hub (40) may be provided with a retainer (44) on the inner diameter, shown in the present Figure as a step profile. The step profiles, stop (34), and retainer (44), may be continuous or be one or more discrete tabs. When the media sub-assembly (12*a*) is assembled, the retainer (44) of the third hub (40) is aligned under the stop (34) of the second hub (30). Thus the step (34) on the second hub (30) limits, along with the slidable engagement of the third hub (40) with the stop (19) on the inner wall (17) of the cylindrical depression (16), the movement of the third hub (40) and the biasing of the third hub (40) by the second spring (26).

Figure 4:
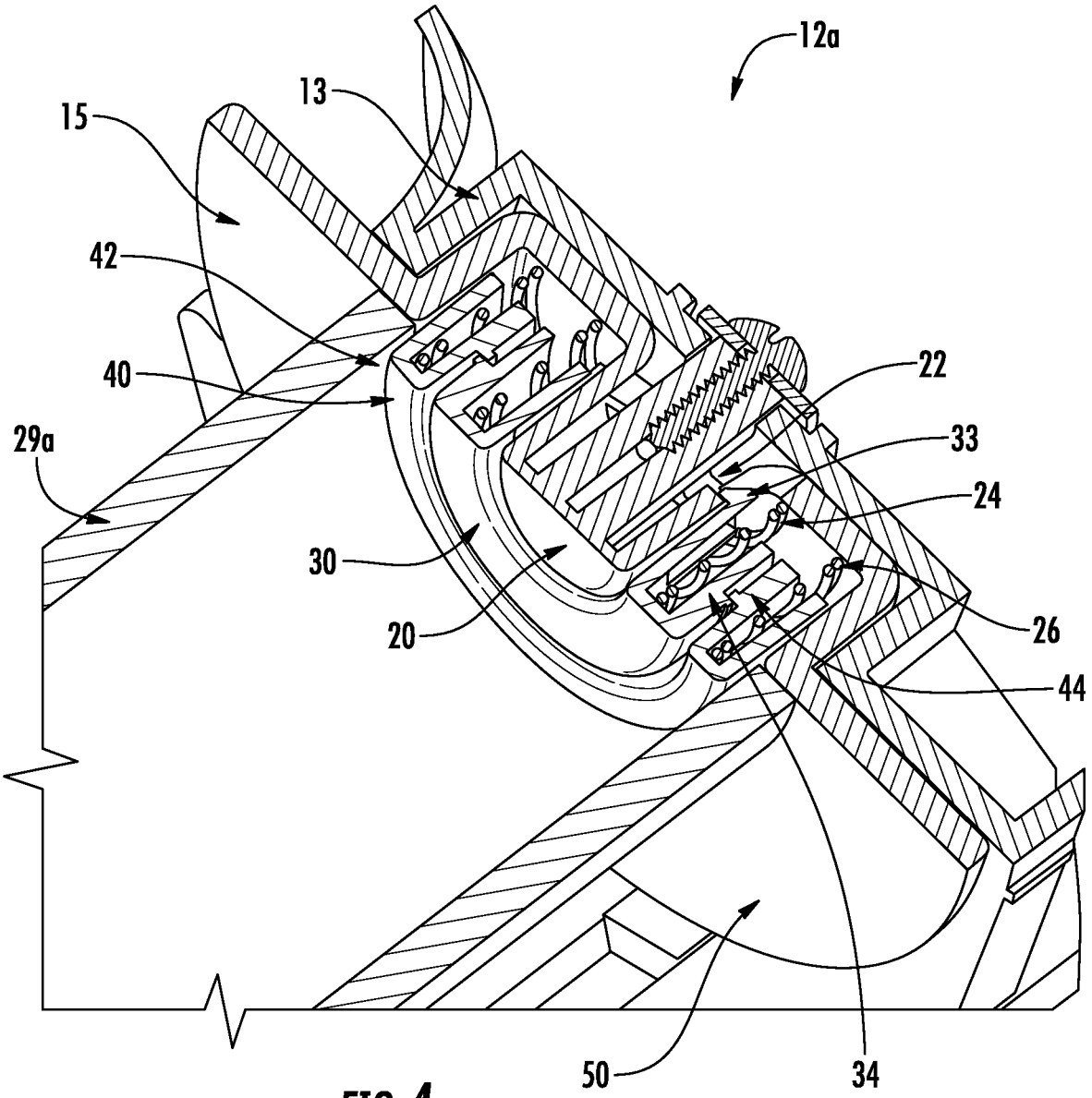
FIG. 4 schematically depicts a cross-sectional view of the media sub-assembly of FIG. 1A when a large diameter media roll is being loaded onto the printer.
Figure 5:
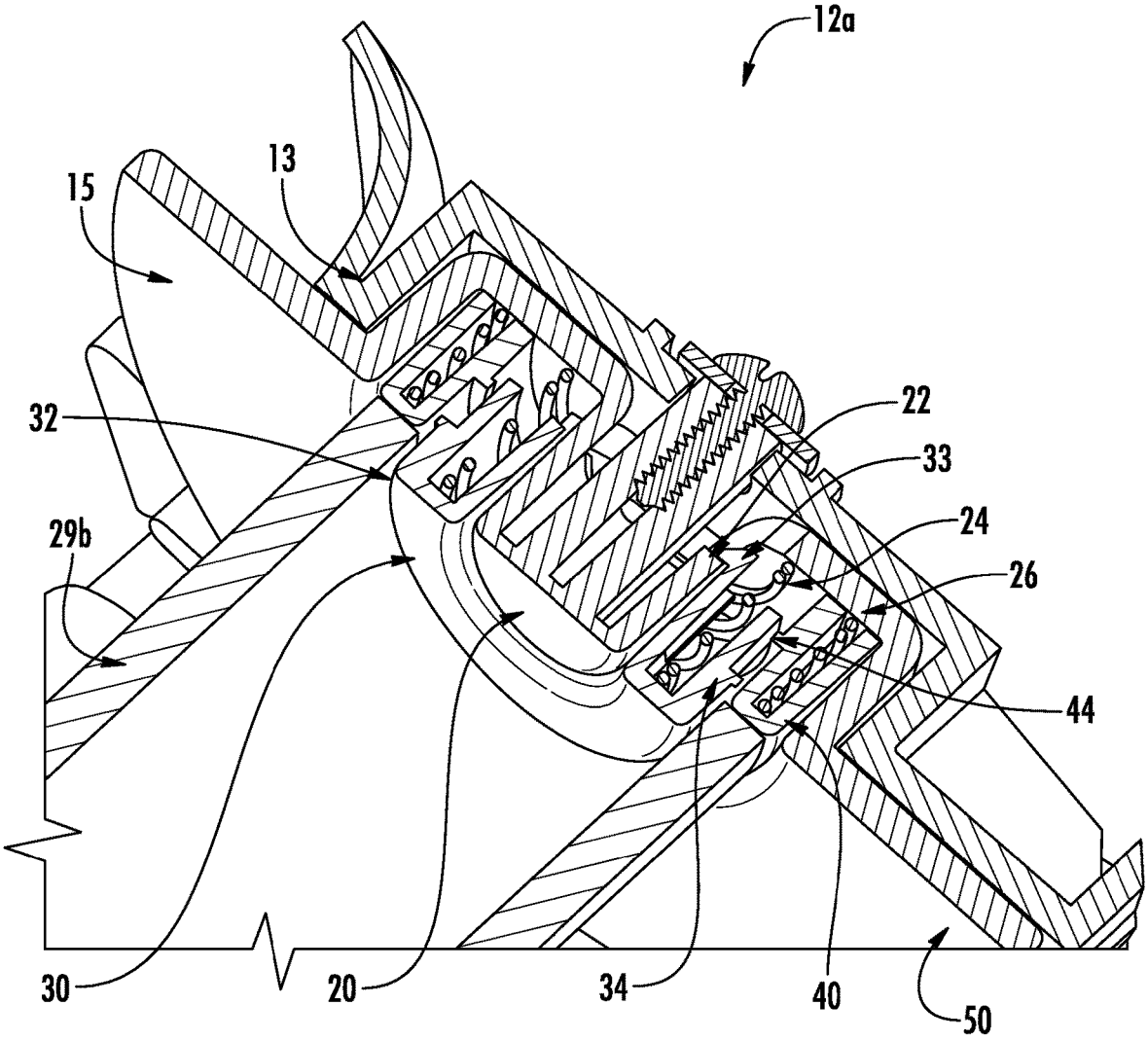
FIG. 5 schematically depicts a cross-sectional view of the media sub-assembly of FIG. 1A when a medium diameter media roll is being loaded onto the printer.
Figure 6:
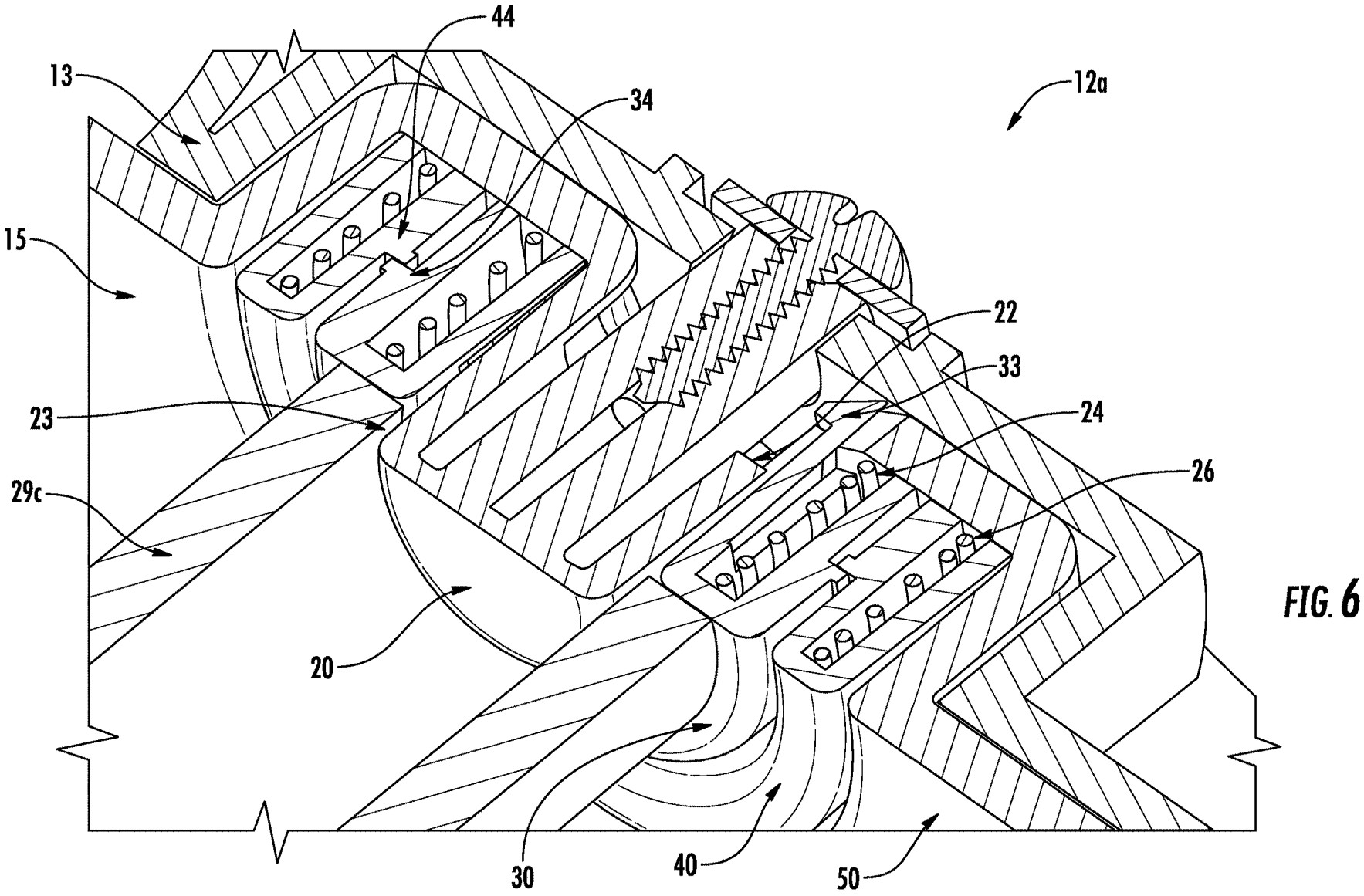
FIG. 6 schematically depicts a cross-sectional view of the media sub-assembly of FIG. 1A when a small diameter media roll is being loaded onto the printer.

FIGS. 4, 5, and 6 show cross-sectional views of the media sub-assembly (12*a*) when media rolls of various diameters are loaded onto the media assembly (11). For example, the media assembly may be designed for media rolls of 1 inch inner diameter, 0.75 inch inner diameter, and 0.4 inch inner diameter, which are standard industry sizes for mobile barcode printers. However, it is to be understood that other media roll sizes can be accommodated. In fact, the media sub-assembly (12*a*) is not limited to accommodating only 3 media rolls. It is readily apparent to those skilled in the art that by adjusting dimensions and adding hubs, more than 3 sizes of media rolls could be accommodated by the same mechanisms of the present invention.

Referring now to FIG. 4, a large diameter media roll (29*a*), for example a 1 inch inner diameter media roll, sits on the flange (50) and around the third hub (40). The exterior surface (42) of the third hub (40) supports the media roll (29*a*).

In FIG. 5, a medium diameter media roll (29*b*), for example a 0.75 inch inner diameter media roll, is shown loaded on the media sub-assembly (12*a*). As described hereinbefore, the media roll (29*b*) length is equal to the distance (28) between the two platforms on the media assembly (11). The media roll (29*b*) is loaded on top of the third hub (40) and is supported around the second hub (30) by the exterior surface (32) of the second hub (30), compressing the second spring (26) such that the third hub (40) descends to substantially the same level as the flange (50). Note also, that third hub (40) retainer (44) is now disengaged from second hub (30) stop (34).

In FIG. 6, a small diameter media roll (29*c*), for example a 0.4 inch inner diameter media roll, is shown loaded on the media sub-assembly (12*a*). As described hereinbefore, the media roll (29*c*) length is equal to the distance (28) between the two platforms on the media assembly (11). The media roll (29*c*) is mounted on top of the second hub (30) and is supported by the exterior surface (23) of the first hub (20), compressing the first spring (24) such that the second hub (30) descends to substantially the same level as the flange (50). Note here that second hub (30) stop (34) remains in engaged with third hub (40) retainer (44) so that both the second hub (30) and the third hub (40) descend together. Additionally, second hub retainer (33) is disengaged from first hub (20) stop (22) as the media roll is inserted on top of the second hub (30).

As can be seen from FIGS. 4, 5, and 6, in the present embodiment shown, the stop (22) on the first hub (20) is not continuous around the exterior surface (23) of the first hub (20) as the stop (22) is only visible on one side of the cross-sectional view. In FIG. 3, the stop (22) was visible on both sides of the cutaway. In a like manner, the at least one stop (19) on the inner wall of the cylindrical depression (16) is discontinuous in the present FIG. 6 and not visible on either side of the cutaway. As discussed hereinbefore, the at least one stop (22) of the first hub (20) and the at least one stop (19) on the inner wall (17) of the cylindrical depression (16) may take one of several forms such as an annular groove, a series of recesses, protrusions, cutouts, or notches and the like.

As can be seen from FIGS. 4, 5, and 6, the slidable engagement between second hub (30) and the third hub (40) allows the third hub (40) enough movement for the second hub's (30) exterior surface (32) to support a media roll sized for the second hub (30) when such a media roll is loaded on the media sub-assemblies. In a like manner, the slidable engagement of the second hub (30) with the first hub (20) provides enough movement of the second hub (30) for the first hub's (20) exterior surface (23) to support a media roll sized for the first hub (20) when such a media roll is loaded on the media sub-assemblies.

The first spring (24) and the second spring (26) in any of the foregoing figures have spring constants. Preferably the spring constants are different, and more preferably, the first spring constant is less than or equal to the second spring constant. As can be seen in FIG. 6, loading a media roll (29*c*) to be supported by the exterior surface (23) of the first hub (20), works against the biasing spring force of both the first spring (24) and second spring (26). Advantageously, the first spring (24) constant will be less than the second spring (26) constant so that it is not too difficult to load the media roll (29*c*) as spring constants are additive in this configuration. In FIG. 5, loading the media roll (29*b*) only requires pressure against the third hub (40), that is, working against the biasing spring force of the second spring (26).

Figure 7:
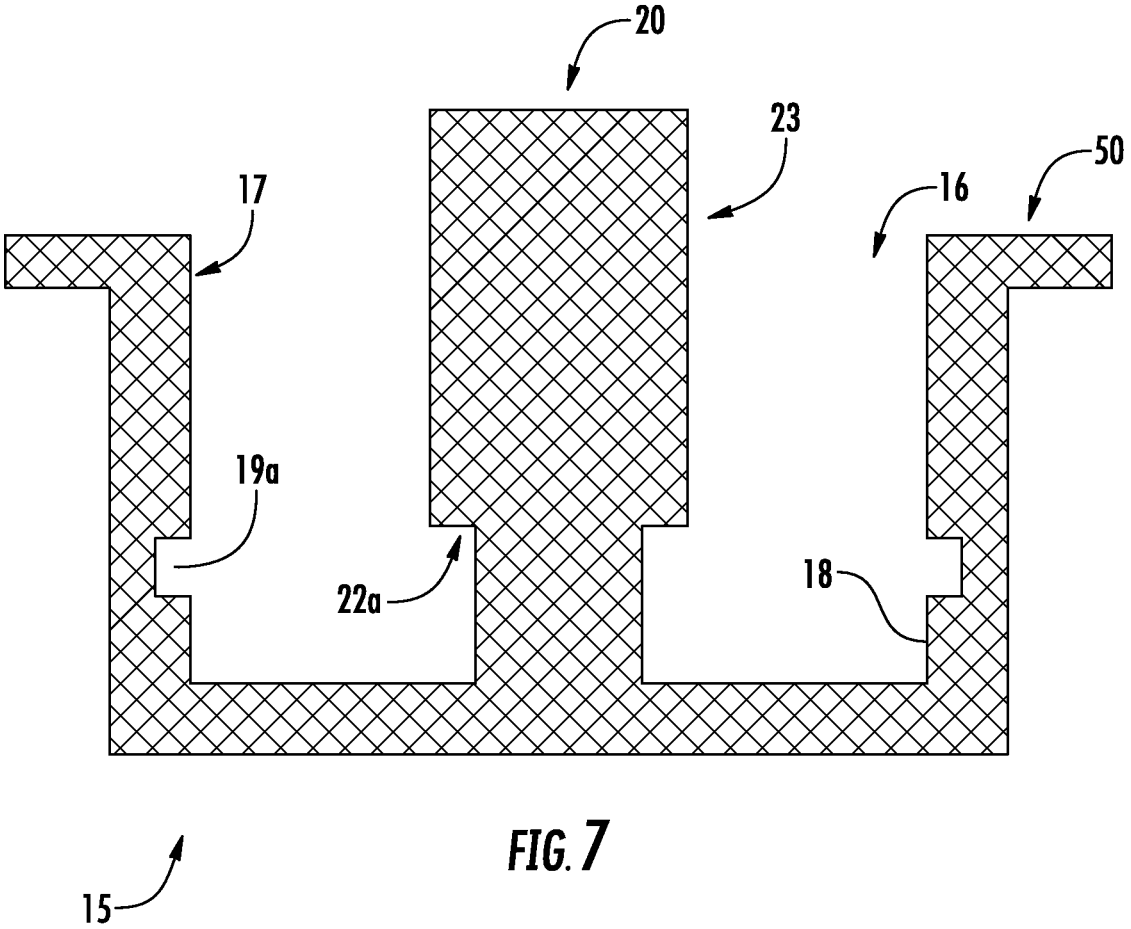
FIG. 7 schematically depicts a cross-sectional view of the platform and the first hub in accordance with an exemplary embodiment of the present invention.

Referring now to FIG. 7, depicted is the platform (15) and first hub without the other hubs or springs assembled in order to see certain features. The platform (15) has a cylindrical depression (16) and a flange (50). The first hub (20) protrudes from the cylindrical depression (16) above the flange (50). In the present FIG. 7, the at least one stop (19*a*) discussed hereinbefore is shown as one or more recesses on the inner wall (17) of the cylindrical depression (16). The recess could be continuous as in an annular groove, or a series of recesses, cutouts, or notches. Similarly, the at least one stop (22*a*) on the exterior surface (23) of the first hub (20) is shown as a cutout near the bottom of the first hub (20).

Figure 8:
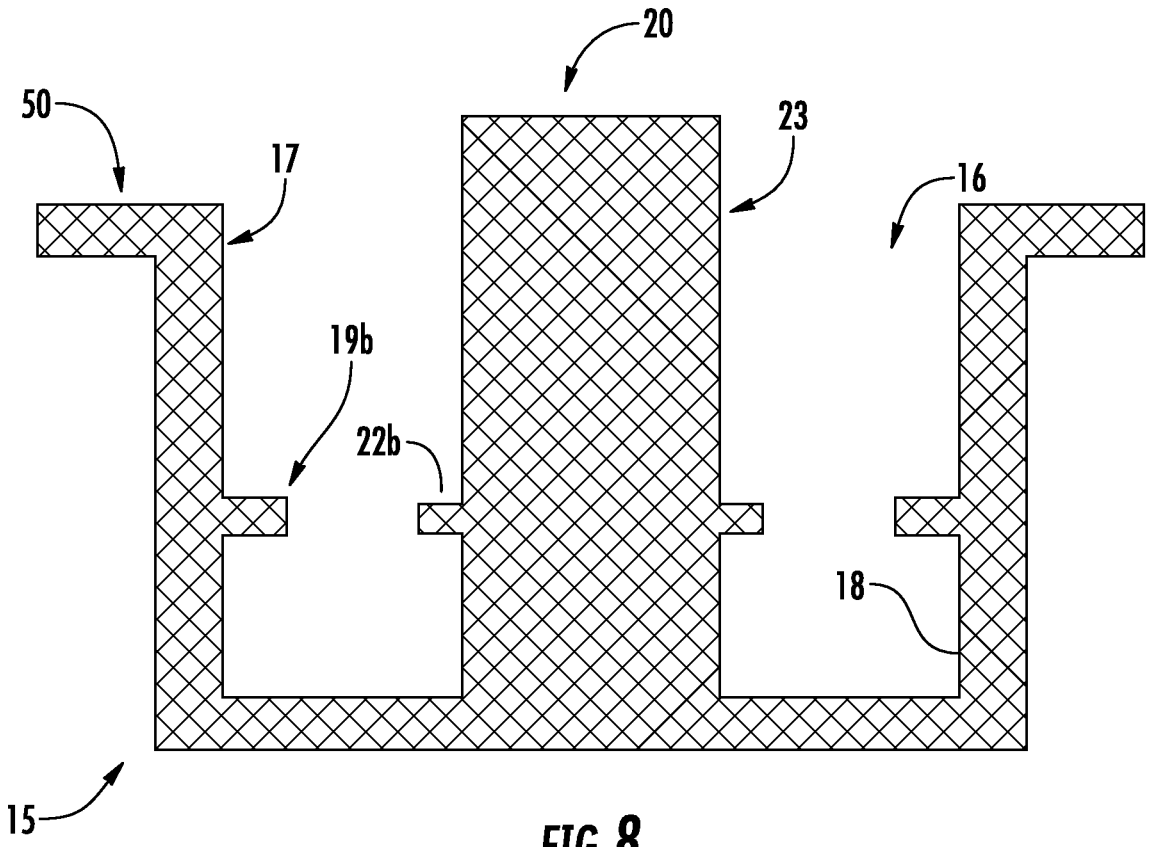
FIG. 8 schematically depicts a cross-sectional view of the platform and the first hub in accordance with another exemplary embodiment of the present invention.

Referring now to FIG. 8, an alternate stop (22*b*) pattern for the first hub (20) and the stop (19*b*) on the inner wall (17) is depicted. The at least one stop (19*b*) on the inner wall (17) of the cylindrical depression (16) is a protruding tab. The protruding tab stop (19*b*) could be a continuous step, or a series of tabs on the inner wall (17). The first hub (20) has at least one stop (22*b*) on the exterior surface (23). In one embodiment, the at least one stop is a continuous tab or series of protruding tabs.

Figure 9:
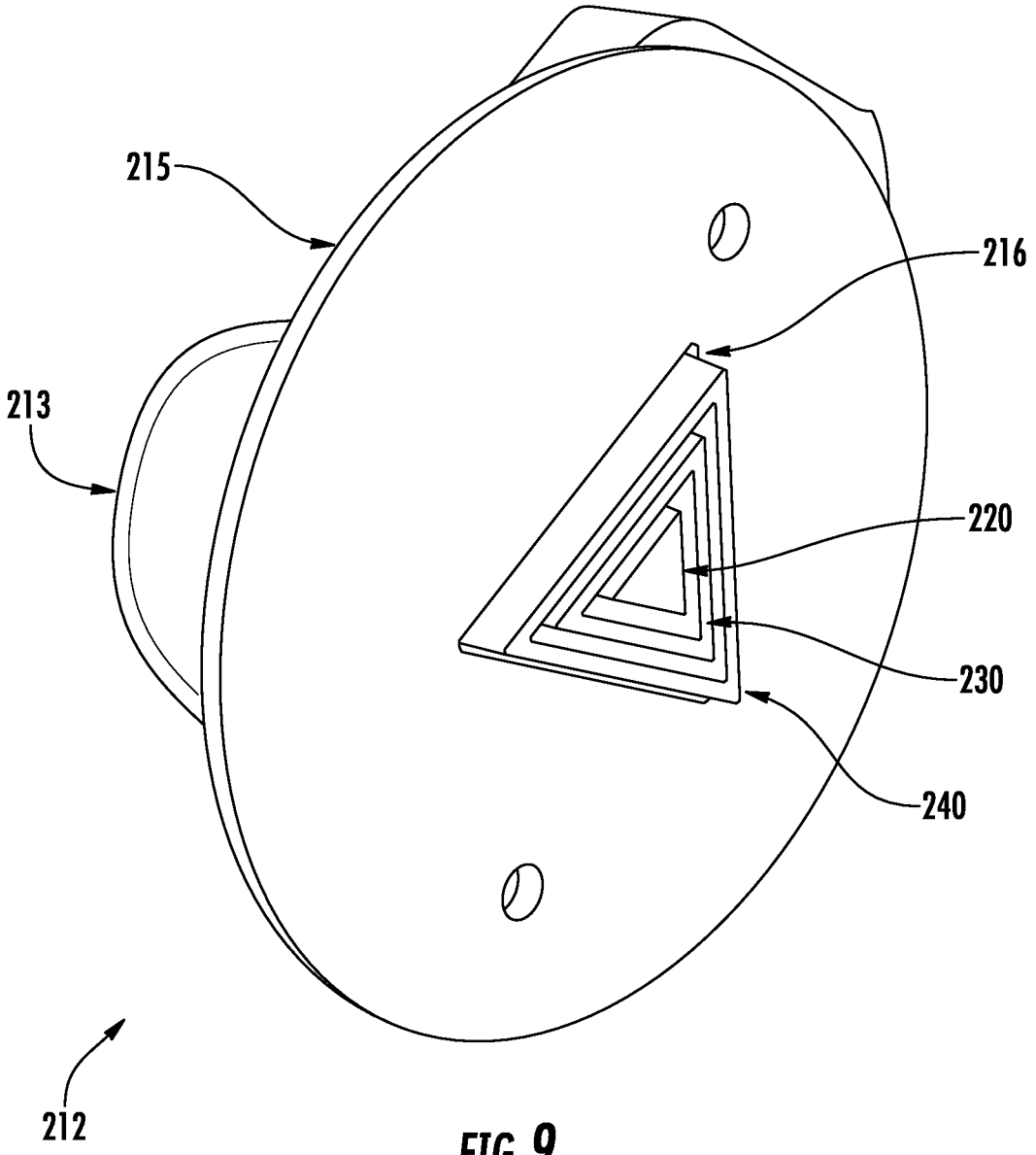
FIG. 9 schematically depicts a perspective view of another exemplary embodiment of the present invention where the hubs are noncircular in cross-section.

Referring now to FIG. 9, as discussed herein before, the hubs may be noncircular in cross-section. FIG. 9 shows one example. A media holder (212) is comprised of a base (213) and a platform (215) secured to the base. The base and the platform may be a single component or separate components as shown. The platform (215) has a centrally located triangularly-shaped depression (216). The first hub (220), the second hub (230), and the third hub (240) have triangular cross-sectional shapes to fit in the shaped depression (216). The hubs (220, 230, and 240) may have sides which are perpendicular to the platform (215) or, in an alternative embodiment, have sides which taper. Hubs with tapered sides may accommodate media rolls with poor tolerances from the factory. Hubs with tapered sides also provide a convenience when mounting the media rolls on the hubs. As in the exemplary embodiments described hereinbefore, in all other aspects, the media holder (212) has components and functions as described in conjunction with the circular hubs.

FIG. 9 illustrates one option for non-circular hubs, but there are other options in accordance with the present invention, including exemplary embodiments wherein the hubs have different cross-sectional shapes. As long as the hubs are concentric and all the hubs are encompassed by the central depression in the platform, the media holder functions as described hereinbefore in conjunction with the circular hubs and the cylindrical depression.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A printer having a pair of media holder sub-assemblies, each sub-assembly comprising:

a platform having a generally cylindrical depression central to the platform, the cylindrical depression having an inner wall;

a first hub sized to support a first media roll, the first hub protruding from the center of the cylindrical depression and having a height greater than the depth of the cylindrical depression;

a first spring concentric to the first hub and disposed in the cylindrical depression;

a second hub sized to support a second media roll, the second hub being concentric to the first hub, the second hub being supported by the first spring in the cylindrical depression, the first spring biasing the second hub to a height substantially equal to the height of the first hub, the second hub being slidably engaged to the first hub;

a second spring, concentric to the first hub and sized to fit around the second hub;

a third hub sized to support a third media roll, the third hub sized to fit around the second hub and within the inner wall of the cylindrical depression, the third hub being supported by the second spring, the second spring biasing the third hub to a height substantially equal to the height of the first hub, the third hub being slidably engaged to the second hub and to the inner wall of the cylindrical depression.

2. The media holder assembly of claim 1, wherein the slidable engagement of the second hub to the first hub allows movement of the second hub from a height substantially equal to the height of the first hub to a position lower in height than the height of the first hub; and wherein the slidable engagement between the third hub and the second hub and between the third hub and the inner wall of the cylindrical depression allows movement of the third hub from a height substantially equal to the height of the first hub to a position lower in height than the height of the first hub.

3. The media holder assembly of claim 2, wherein the cylindrical depression has a bottom, the cylindrical depression having at least one stop on the inner wall, the stop being a first predetermined distance from the bottom of the inner wall; wherein the first hub has an exterior surface and a bottom, the first hub having at least one stop on the exterior surface of the first hub, the stop being a second predetermined distance from the bottom of the first hub; wherein the second hub has a bottom, an inner surface, and an exterior surface, the second hub having at least one retainer at the bottom of the inner surface and disposed in a position below the at least one stop on the first hub, the second hub having at least one stop on the exterior surface; wherein the third hub has an inner surface and an exterior surface, the third hub having at least one retainer on the exterior surface of the third hub disposed in a position below the at least one stop in on the inner wall of the cylindrical depression, the third hub having at least one retainer on the inner surface of the third hub, the retainer being aligned below the at least one stop on the exterior surface of the second hub.

4. The media holder of claim 3, wherein the first predetermined distance is substantially equal to the difference between the height of the first hub and the depth of the cylindrical depression.

5. The media holder of claim 3, wherein the second predetermined distance is substantially equal to the difference between the height of the first hub and the depth of the cylindrical depression.

6. The media holder of claim 1, wherein the media holder sub-assemblies are configured to slidably adjust based upon a media roll being loaded on the media holder; the distance between the platforms on the opposedly mounted media holder sub-assemblies being substantially equal to the length of the media roll.

7. The media holder of claim 6, wherein when a media roll sized to be supported by the second hub is mounted in the media holder, pressure is applied to the third hub on each of the media holder sub-assemblies, compressing the second spring and sliding the third hub towards the bottom of the cylindrical depression.

8. The media holder of claim 6, wherein when a media roll sized for the first hub is being mounted in the media holder, pressure is applied to second hub on each of the media holder sub-assemblies, compressing the first spring and sliding the second hub towards the bottom of the cylindrical depression.

9. The media holder of claim 8, wherein the second spring is compressed and the third hub slides towards the bottom of the cylindrical depression when pressure is applied to the second hub, based upon the slidable engagement of the second hub to the third hub.

10. The media holder of claim 1, wherein the first hub is sized to support a media roll having a substantially 0.4 inch inner diameter; the second hub is sized to support a media roll having a substantially 0.75 in inner diameter; and the third hub is sized to support a media roll having a substantially 1.0 inch inner diameter.

11. The media holder of claim 1, wherein the first spring has an uncompressed height greater than the height of the second hub; and the second spring has an uncompressed height greater than the height of the third hub.

12. A media holder comprised of:

a platform having a flange and a shaped depression central to the platform, the shaped depression having an inner wall;

a first hub having an exterior surface to support a first media roll, the first hub protruding from the center of the shaped depression and having a height greater than the depth of the shaped depression;

a first spring concentric to the first hub and disposed in the shaped depression; and a second hub having an exterior surface to support a second media roll, the second hub concentric to the first hub, the second hub supported by the first spring in the shaped depression, the first spring biasing the second hub to a height substantially equal to the height of the first hub, the second hub being slidably engaged to the first hub.

13. The media holder of claim 12, further comprising:

a second spring, concentric to and sized to fit around the second hub; and a third hub having an exterior surface to support a third media roll, the third hub being concentric to the second hub, the third hub being supported by the second spring, the second spring biasing the third hub to a height substantially equal to the height of the first hub, the third hub being slidably engaged to the second hub.

14. The media holder of claim 13, wherein the slidable engagement of the third hub to the second hub allows movement of the third hub from a position of substantially equal height to the height of the first hub to a position lower in height than the height of the first hub; and wherein the slidable engagement between the second hub and the first hub allows movement of the second hub from a height substantially equal to the height of the first hub to a position lower in height than the height of the first hub.

15. The media holder of claim 14, wherein, when a media roll sized to be supported by the exterior surface of the second hub is supported by the second hub, pressure is applied to the third hub of the media holder, compressing the second spring and sliding the third hub towards the bottom of the shaped depression.

16. The media holder of claim 13, wherein the exterior surface of the first hub is sized to support a media roll having a substantially 0.4 inch inner diameter; the surface of the second hub is sized to support a media roll having a substantially 0.75 in inner diameter; and the surface of the third hub is sized to support a media roll having a substantially 1.0 inch inner diameter.

17. The media holder of claim 13, wherein the first spring has a spring constant different from the spring constant of the second spring.

18. The media holder of claim 13, wherein the first spring has a spring constant less than or equal to the spring constant of the second spring.

19. The media holder of claim 12, wherein, when a media roll sized to be supported by the exterior surface of the first hub is supported by the first hub, pressure is applied to the second hub of the media holder, compressing the first spring and sliding the second hub towards the bottom of the cylindrical depression; and wherein the second spring is compressed and the third hub slides towards the bottom of the shaped depression when pressure is applied to the second hub, based upon the slidable engagement of the second hub to the third hub.

20. The media holder of claim 19, wherein the second hub has an inner surface, the second hub having at least one stop on the exterior surface; wherein the third hub has an inner surface, the third hub having at least one retainer on the inner surface of the third hub, the at least one retainer on the inner surface of the third hub being positioned to align below the at least one stop on the exterior surface of the second hub.

21. The media holder of claim 12, wherein the first hub and the second hub have a common cross-sectional shape.

22. The media holder of claim 12, wherein the first hub and the second hub have different cross-sectional shapes.

* * * * *